US011420808B2

(12) United States Patent
Takahashi

(10) Patent No.: US 11,420,808 B2
(45) Date of Patent: Aug. 23, 2022

(54) SCENTED TISSUE PRODUCT AND METHOD OF MAKING SCENTED TISSUE PRODUCT

(71) Applicant: DAIO PAPER CORPORATION, Ehime (JP)

(72) Inventor: Sachiko Takahashi, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 0 days.

(21) Appl. No.: 16/807,368

(22) Filed: Mar. 3, 2020

(65) Prior Publication Data

US 2020/0198874 A1 Jun. 25, 2020

Related U.S. Application Data

(62) Division of application No. 15/115,986, filed as application No. PCT/JP2015/054241 on Feb. 17, 2015, now abandoned.

(30) Foreign Application Priority Data

Feb. 27, 2014 (JP) ..... 2014-037571

(51) Int. Cl.
*B65D 83/08* (2006.01)
*B31B 50/81* (2017.01)
(Continued)

(52) U.S. Cl.
CPC ..... *B65D 83/0805* (2013.01); *B31B 50/81* (2017.08); *B31B 50/82* (2017.08);
(Continued)

(58) Field of Classification Search
CPC ..... A47K 10/421; B31B 1/82; B31B 1/90; B31B 2203/066; B31B 2203/12
See application file for complete search history.

(56) References Cited

U.S. PATENT DOCUMENTS 3,591,069 A * 7/1971 Heller, Jr. ..... B65D 5/4204 229/162.3
4,247,349 A * 1/1981 Detert ..... B26D 7/018 156/108
(Continued)

FOREIGN PATENT DOCUMENTS

JP S60-146084 U 9/1985
JP H03-066883 U 6/1991
(Continued)

OTHER PUBLICATIONS

International Search Report dated May 26, 2015 issued to PCT/JP2015/054241.
(Continued)

*Primary Examiner* — Gene O Crawford
*Assistant Examiner* — Kelvin L Randall, Jr.
(74) *Attorney, Agent, or Firm* — IPUSA, PLLC

(57) ABSTRACT

[Object] A scented tissue product is provided that offers excellent tissue removability and that enables a scent to be felt continuously in a stable manner.

[Solution] The object is achieved by a scented tissue product in which a fragrant film having a fragrance layer situated between a fragrance-permeable resin layer and a fragrance-impermeable resin layer is attached, separately from a film having a slit therein for covering a dispensing opening, to an area including at least part of an inner surface of the top face of a box member constituting a container box such that the fragrance-permeable resin layer faces a stack of tissues.

1 Claim, 13 Drawing Sheets

(51) Int. Cl.
*B31B 110/35* (2017.01)
*B31B 50/82* (2017.01)
*B31B 100/00* (2017.01)

(52) U.S. Cl.
CPC ..... *B31B 2100/00* (2017.08); *B31B 2110/35* (2017.08); *B65D 2203/12* (2013.01)

(56) References Cited

U.S. PATENT DOCUMENTS 4,704,173 A * 11/1987 Hoffman ..... B29C 66/65 156/212
4,874,129 A * 10/1989 DiSapio ..... A45D 40/0087 239/36
5,060,853 A * 10/1991 Gulliver ..... B65D 5/4204 229/162.1
5,097,651 A * 3/1992 Decottignies ..... B65D 33/02 53/451
5,341,992 A * 8/1994 Bishopp ..... A47K 10/38 239/34
6,068,583 A * 5/2000 Sigi ..... B65D 83/0811 206/494
D504,314 S * 4/2005 Kim ..... D9/416
7,201,714 B2 * 4/2007 Zoeckler ..... B65D 5/445 493/345
7,585,530 B2 * 9/2009 Etchells ..... A23B 4/16 206/204
2004/0124101 A1 * 7/2004 Mitchell ..... B65D 83/0805 206/205
2006/0219812 A1 * 10/2006 Stephens ..... B65D 5/4233 239/302
2008/0022872 A1 * 1/2008 Nanisetty ..... B26D 5/20 101/226
2008/0237330 A1 * 10/2008 Grossmann ..... B65D 5/4204 229/126
2009/0127149 A1 * 5/2009 Samareq ..... B65D 5/4204 206/494
2009/0208656 A1 * 8/2009 Brown ..... A61B 42/40 427/331
2010/0006233 A1 * 1/2010 Deckert ..... B65C 9/1819 156/510
2010/0243668 A1 * 9/2010 Castela ..... B65D 83/0805 221/45
2011/0042257 A1 * 2/2011 Mueller ..... B65D 77/24 206/494
2016/0244241 A1 * 8/2016 Hirata ..... A47K 10/32

FOREIGN PATENT DOCUMENTS

JP H07-021584 U 4/1995
JP H08-000294 Y 1/1996
JP H11-089922 4/1999
JP 2004115055 A * 4/2004
JP 2006-198556 8/2006
JP 2007-182248 7/2007
JP 2010-052815 3/2010
JP 2010-179946 8/2010
JP 2013-203043 10/2013
JP 2014196132 A * 10/2014

OTHER PUBLICATIONS

Extended European Search Report dated Dec. 8, 2016 issued to EP15755697.8.
Korean Office Action for 10-2016-7020902 dated Jan. 5, 2018.

* cited by examiner

SCENTED TISSUE PRODUCT AND METHOD OF MAKING SCENTED TISSUE PRODUCT

CROSS-REFERENCE TO RELATED APPLICATIONS

This application is a divisional of U.S. patent application Ser. No. 15/115,986 filed on Aug. 2, 2016, which is a national phase application of PCT/JP2015/054241 filed on Feb. 17, 2015, which is based on and claims priority to Japanese patent application No. 2014-037571 filed on Feb. 27, 2014. The entire contents of these applications are hereby incorporated by reference.

TECHNICAL FIELD

The present invention relates to a scented tissue product and a method of making a scented tissue product.

BACKGROUND ART

The tissue product is well-known that has a stack of tissues contained in a container box which has an upper-surface opening covered with a film having a slit, and the tissues contained in the box are removed one by one (which may be a pair of tissues) through the slit. Some of such products may be scented.

A scented product may use tissues that are infused with fragrance, or may use microcapsules with fragrance contained therein that are attached to the surface of the slit film covering the upper-surface opening, such that a tissue smashes some of the microcapsules at the time of removing the tissue to cause the fragrance to be released (see Patent Document 1 and the like).

The location at which the tissues come in contact with the film in this product stays substantially unchanged up to the time the tissues are used up. Because of this, while a strong scent is noticeable during an early period after the opening of the box, the scent rapidly decreases with continued use, thereby giving rise to the difficulty of providing sustained strong scent.

In order to provide sustained strong scent, some proposed slit films that cover the upper-surface opening may utilize a multilayered structure that includes fragrance-permeable film layers with a fragrance layer inserted therebetween that is made of an adhesive mixed with fragrance. Fragrance is gradually dispensed through the film layers.

However, a slit film covering the upper-surface opening of a tissue product is required to allow a tissue to be smoothly pulled out therethrough and also to have adequate rigidity to hold part of the pulled-out tissue at the edges of the slit to prevent the pulled-out tissue from falling to the inside. When the slit film is implemented as a multilayered structure, the rigidity of the film becomes excessively high due to the adhesive contained in the fragrance layer and due to an increase in the thickness caused by the use of multilayers. There is thus a problem in that tissues are not smoothly removed, with an increased risk of tearing.

Further, the position at which the slit film is situated is the center of the inner top surface of the container. Due to the presence of the slit, the use of the multilayered structure including a fragrance layer ends up allowing some lighter-than-air components of the fragrance contained in the fragrance layer to volatilize and easily escape to the outside. On the other hand, some components heavier than air are likely to be attached to some of the tissues situated toward the top of the stack of tissues that faces the slit film inside the container box. There is thus a risk of failing to add an adequate strength of scent evenly to the entirety of tissues inside the container box.

RELATED-ART DOCUMENTS

Patent Document

[Patent Document 1] Japanese Laid-open Patent Publication No. 2010179946

[Patent Document 2] Japanese Laid-open Patent Publication No. 2007182248

[Patent Document 3] Japanese Laid-open Patent Publication No. 201052815

[Patent Document 4] Japanese Laid-open Patent Publication No. 2006198556

SUMMARY OF INVENTION

Problem to be Solved by Invention

A main object of the present invention is to provide a scented tissue product that provides excellent tissue removability and that enables a desired scent to be felt continuously in a stable manner from the beginning of use.

Solution to Problem

The present invention that solves the above-noted problem and the function and effect thereof are as follows.

A scented tissue product having a stack of tissues folded and placed one over another accommodated in a container box which has a cuboid-shaped box member having a top face, a bottom face, and, connected thereto, a pair of longitudinal lateral faces and a pair of transverse lateral faces, an opening-purpose perforation formed in the box member, and a film having a slit therein being attached such as to have the slit situated in an area enclosed by the opening-purpose perforation, wherein a fragrant film having a fragrance layer situated between a fragrance-permeable resin layer and a fragrance-impermeable resin layer is attached, separately from the film having a slit therein, to an area including at least part of an inner surface of the top face of the box member such that the fragrance-permeable resin layer faces the stack of tissues.

Advantageous Effects of Invention

According to the present invention noted above, a scented tissue product is provided that provides excellent tissue removability and that enables a desired scent to be felt continuously in a stable manner from the beginning of use.

EMBODIMENTS FOR CARRYING OUT INVENTION

Figure 1:
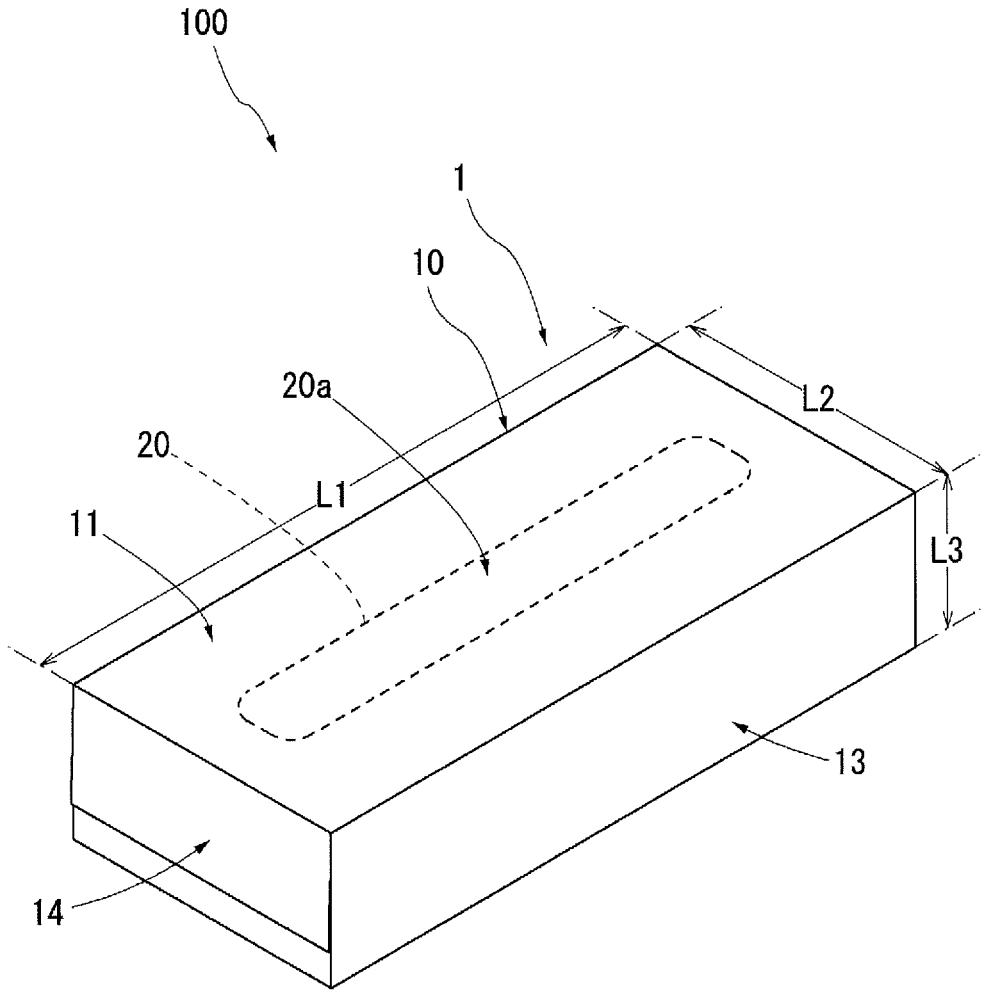
FIG. 1 is a diagonal perspective view of a tissue product according to an embodiment of the present invention.
Figure 2:
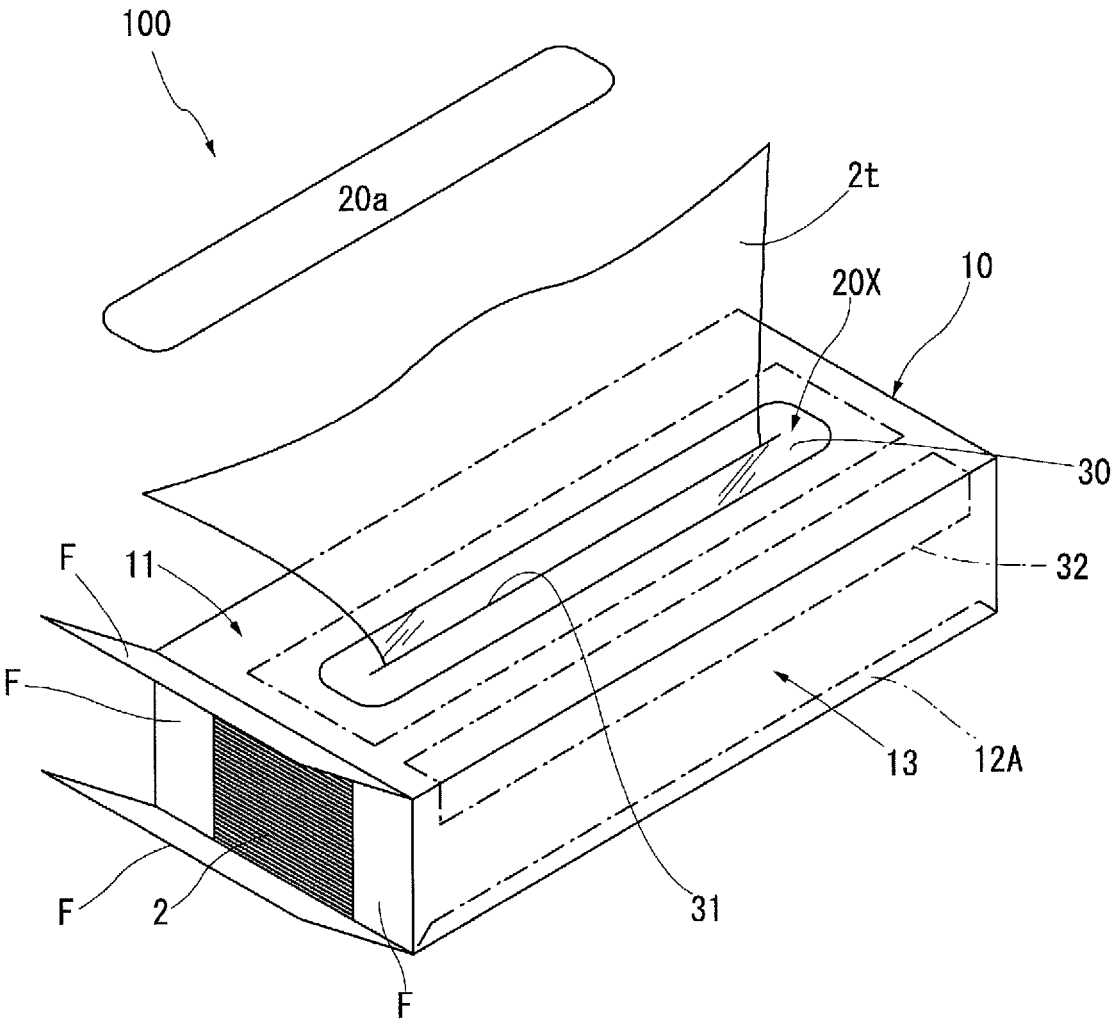
FIG. 2 is a diagonal perspective view for explaining the structure of the tissue product according to the embodiment of the present invention.

Embodiments of the present invention will be described by referring to FIG. 1 through FIG. 13. As illustrated in FIG. 1 and FIG. 2, a tissue product 100 according to the present embodiment has a tissue stack 2 comprised of tissues 2*t* folded and placed one over another, which is stored in a container box 1 that has a perforation in a top face 11 for opening purposes. A tissue 2*t* to be used is pulled out through a dispensing opening 20X formed by tearing an opening-purpose perforation 20.

The container box 1 illustrated in the figure has a cuboid product appearance. The container box 1 includes a box member 10 having the opening-purpose perforation 20 for forming the dispensing opening 20X in the top face 11, and includes a film 30 having a slit therein that covers an area 20*a* enclosed by the opening-purpose perforation 20 from the inner side of the top face of the box member.

The box member 10 constitutes the outer casing of the container box 1. The box member 10 has a size, an outer-appearance shape, a development-view shape, and the like that are adopted from the configuration of a known box member of the container box. The size of a typical container box has a long-side edge L1 of 110 to 320 mm, a short-side edge L2 of 70 to 200 mm, and a height L3 of 40 to 150 mm, more or less. The container box 1 of the present invention may also have this size. The box member may have an appropriate print on the inner faces or outer faces.

The base material of the box member 10 may be known paper material or processed paper material that is made mainly from pulp varieties such as virgin pulp and recycled pulp. A preferred material of the box member 10 is clay coated newsback having a basis weight of 250 to 500 g/m$^2$.

Figure 3:
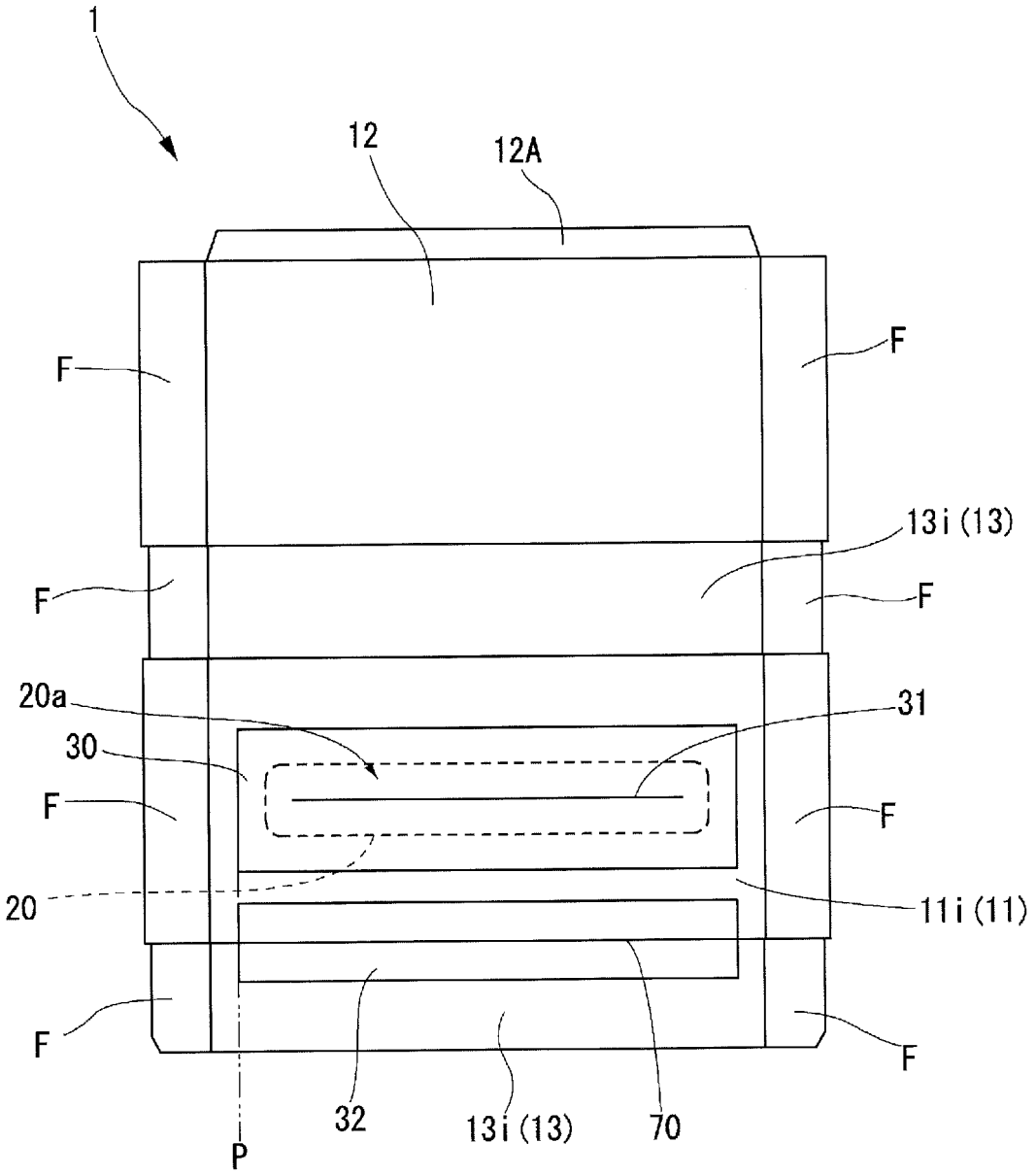
FIG. 3 is a drawing of the development view of a container box, as viewed from the box's inner side, according to the embodiment of the present invention.

As can be seen from FIG. 2 and FIG. 3, the built-up structure of the illustrated box member 10 is made by gluing a bottom face 12 to one longitudinal lateral face 13 by use of a tab 12A to form a tube, followed by folding flaps F inwardly which extend from the bottom face 12 and the adjacent longitudinal lateral faces 13, and then gluing the contact faces of the flaps F together with a hot-melt adhesive or the like to form transverse lateral faces 14. It may be noted that the box member 10 of the present invention is not limited to this built-up structure.

The opening-purpose perforation 20 formed in the top face of the box member 10 has an annular shape. The cut-tie ratio may be set as appropriate. The opening-purpose perforation 20 may be formed as an ordinary perforation, a double perforation, a zipper perforation, or the like. Only part of the opening-purpose perforation 20 may be made into a double perforation.

The opening-purpose perforation 20 according to the present embodiment has long sides extending in the longitudinal direction of the paper box, and has short sides extending parallel to the short edges to connect between the ends of the long edges. The shape of the area 20*a* enclosed by the opening-purpose perforation 20 is longer in the longitudinal direction of the container box 1. In general, the opening-purpose perforation 20 may have an elongated beveled rectangular shape extending in the longitudinal direction of the container box 1, or may have an approximately elliptical shape that is formed by deforming each long side of the noted rectangular shape such that the midpoint thereof bulges outwards to form an arc shape. The illustrated configuration is an example of the former.

The film 30 having a slit therein is larger than the area 20*a* enclosed by the opening-purpose perforation 20, with the shape thereof being rectangular or elliptical, for example. The film 30 having a slit therein is attached with an adhesive to an inner surface 11*i* of the box top face at the outside of the area 20*a* enclosed by the opening-purpose perforation 20 such as not to affect the tearing of the opening-purpose perforation 20. A slit 31 of the film 30 is situated to extend in the longitudinal direction in the area 20*a* enclosed by the opening-purpose perforation 20. As illustrated in FIG. 1 and FIG. 3, thus, tearing and removing all or part of the area 20*a* enclosed by the opening-purpose perforation 20 along the opening-purpose perforation 20 results in the dispensing opening 20X being created in the top face 11 of the paper box. Further, the film 30 having a slit therein and the slit 31 are exposed through the dispensing opening 20X. The tissues 2*t* can thus be removed one by one through the slit 31.

Figure 5:
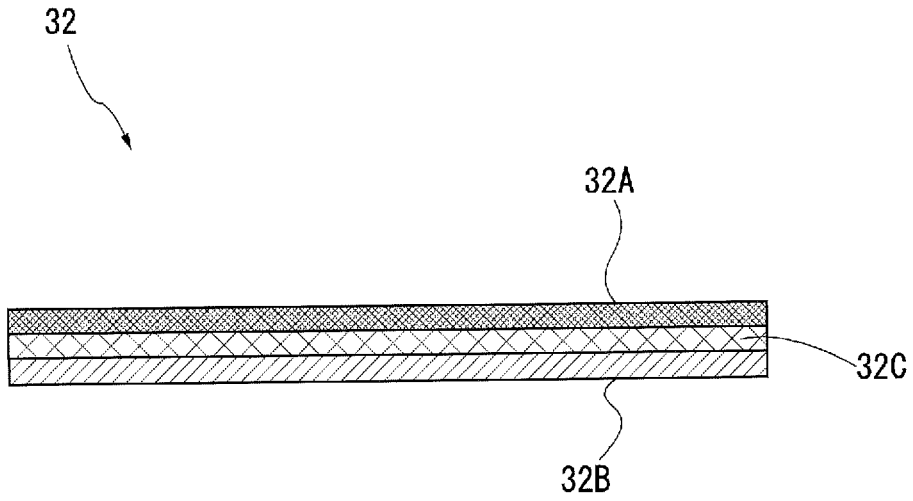
FIG. 5 is a cross-sectional view of a scented film according to the embodiment of the present invention.

The container box 1 of the scented tissue product 100 according to the present invention characteristically has a fragrant film 32, which is separate from the film 30 having a slit therein, as illustrated in FIG. 1 through FIG. 3 and FIG. 6 through FIG. 9. As illustrated in FIG. 5, the fragrant film 32 has a structure in which a fragrance layer 32C is situated between a fragrance-permeable resin layer 32A and a fragrance-impermeable resin layer 32B. The fragrant film 32 is attached to the box member 10 at an area including the inner surface 11*i* of the top face 11 of the box member 10 such that the fragrance-permeable resin layer 32A faces the tissue stack 2. The fragrant film 32 is structured such that the fragrance layer 32C including fragrance is situated between the fragrance-permeable resin layer 32A exhibiting permeability with respect to the fragrance and the fragrance-impermeable resin layer 32B exhibiting impermeability or extremely low permeability with respect to the fragrance. With this arrangement, the fragrance contained in the fragrance layer 32C gradually volatilize through the fragrance-permeable resin layer 32A, thereby exhibiting a more sustained release effect than do configurations that use fragrance directly added to tissues or directly applied to a box inner face. Further, the fragrant film 32 is attached to an inner face of the box member 10 such that the fragrance-permeable resin layer 32A faces the tissue stack 2. Because of this, fragrance is unlikely to escape to the outside even when the box member 10 is made of a permeable material such as paper.

Moreover, the scented tissue product 100 according to the present invention has the fragrant film 32 that is separate from the film 30 having a slit therein for removing the tissues 2*t* one by one. Because of this, the film 30 having a slit therein can be made of a conventional material that is inexpensive and flexible with a proper thickness, such as polyethylene or polypropylene. There is no need to sacrifice the removability of tissues, the productivity of a film, and production cost in exchange of providing the effect to impart a scent to tissues or to the ambient of the product, unlike the case in which the film 30 having a slit therein is implemented as a multilayered film having a fragrance layer. Further, the film 30 having a slit therein needs to have a decent size because of the need to cover the area 20*a* enclosed by the opening-purpose perforation 20 and to have the slit 31 formed therein that is sufficiently long to allow the tissues 2*t* to be removed without tearing. On the other hand, the fragrant film 32 does not need to have such a size from the viewpoint of imparting a scent. The use of a multilayered structure having a fragrance layer as the film 30 having a slit therein ends up using a film having a needlessly large size, resulting in a possible cost increase. The use of a separate film as in the present invention does not give rise to such a problem.

As described above, the scented tissue product 100 according to the present invention uses the film 30 having a slit therein and the fragrant film 32 that are separate from each other, thereby allowing free design choice without compromising the respective effects of these films. That is, it is possible to use the fragrant film 32 having such a thickness or size that is difficult to be used for the film 30 having a slit therein. This allows use of such a design choice as to make the area of the fragrant film smaller than the film having a slit therein and to increase the thickness of the fragrance layer in proportion to the area reduction. In the scented tissue product 100 of the illustrated example according to the present embodiment, the area of the fragrant film 32 is smaller than the area of the film 30 having a slit therein, and the thickness of the fragrant film 32 is thicker than the thickness of the film 30 having a slit therein.

Figure 4:
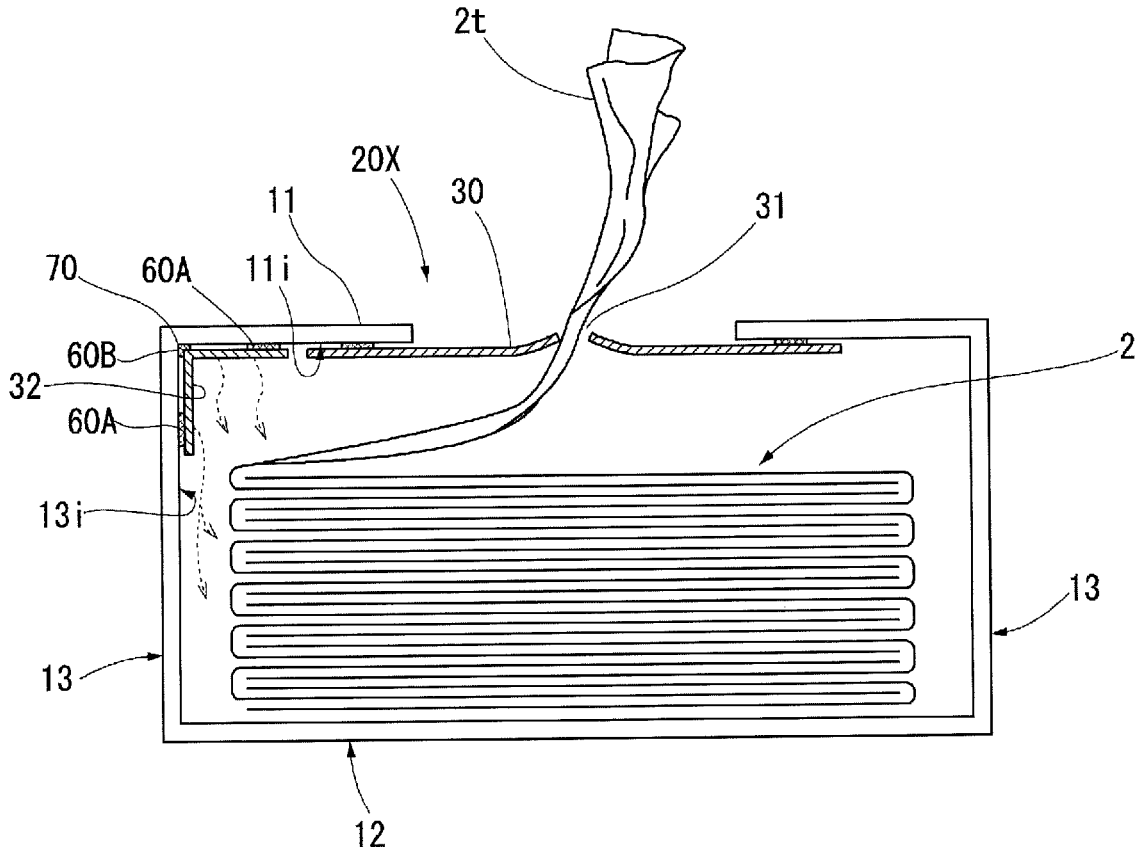
FIG. 4 is a cross-sectional view of the tissue product according to the embodiment of the present invention.

The fragrant film 32 may preferably be attached in such a specific manner as in the example illustrated in FIG. 2, FIG. 3, and FIGS. 6 to 8 in which the fragrant film 32 is attached to an area extending from the inner surface 11*i* of the top face 11 to an inner surface 13*i* of the longitudinal lateral face 13 of the box member 10 across a border edge 70 between these surfaces 11*i* and 13*i*. This arrangement causes heavier-than-air components contained in the fragrance layer to move downwards, as illustrated in FIG. 4 by dotted lines, along the inner surface 13*i* of the longitudinal lateral face 13 of the container box 1. As a result, these heavy components reliably come in contact with a face of the tissue stack 2 constituted by the folded edges of the stacked tissues. When this happens, it is expected that the fragrance also enter gaps between the tissues. As a result, a scent imparted by the heavy components is added to each of the tissues constituting the tissue stack 2, so that there is only a small difference in the strength of scent between the upper portion and lower portion of the tissue stack 2. Further, since the fragrant film 32 is situated at a long distance from the slit 31, lighter-than-air components of the fragrance are unlikely to escape through the slit 31, and are likely to stay inside the container box.

Figure 10:
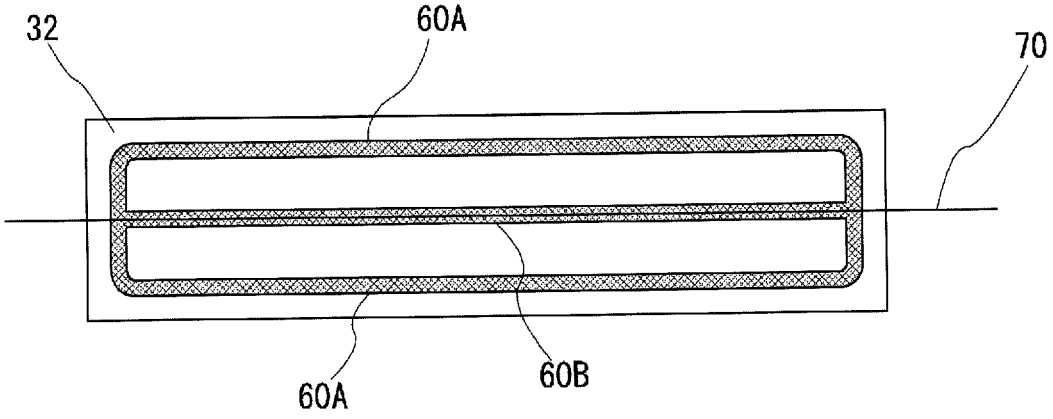
FIG. 10 is a drawing illustrating a manner in which a scented film is glued according to the embodiment of the present invention.
Figure 11:
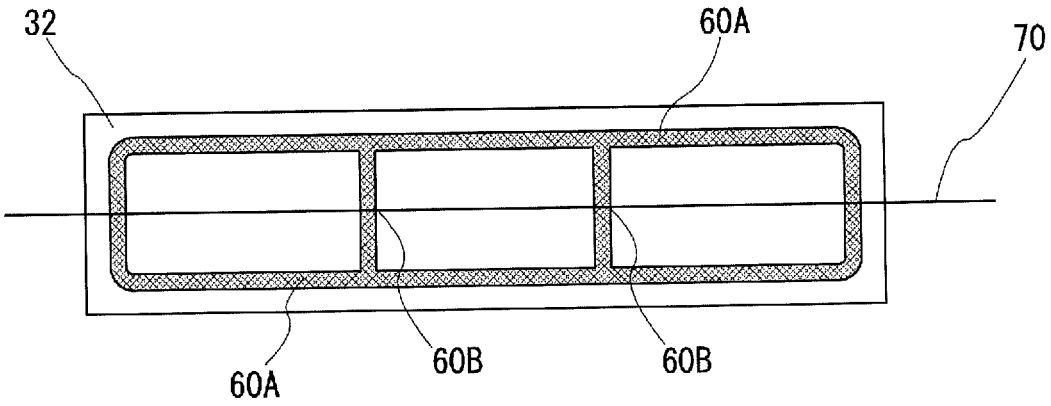
FIG. 11 is a drawing illustrating another manner in which a scented film is glued according to the embodiment of the present invention.

As noted above, the manner of attaching may be such that the fragrant film 32 is attached to an area extending from the inner surface 11*i* of the top face 11 to the inner surface 13*i* of the longitudinal lateral face 13 of the box member 10 across the border edge 70 between these surfaces 11*i* and 13*i*. To this end, it is preferable to dispose an adhesive 60A continuously or at spaced intervals along the perimeter of the fragrant film 32 thereby to prevent the perimeter from peeling off from the box member 10 and also to use an adhesive 60B for gluing to the border edge 70, as illustrated in FIG. 10 and FIG. 11. If the fragrant film 32 is not glued to the border edge 70, the fragrant film 32 may have a slack that bulges toward the center of the container box, and comes in excessive contact with the tissue stack 2. This may increase the resistance that impedes the removal of the tissues 2*t*. It is preferable to attach the fragrant film 32 in a carton-blank state. With the carton-blank state in which the fragrant film 32 is not glued to the border edge 70, however, building the carton blank to form a tube shape causes the fragrant film 32 to corrugate, thereby creating a risk that a subsequent insertion of the tissue stack 2 may not be successful.

A known adhesive that is the same as or similar to the one used for gluing the film 30 having a slit therein may be used as the adhesive for gluing the fragrant film.

In the following, a description will be given of a specific configuration of the fragrant film 32 according to the present embodiment. The fragrance-permeable resin layer 30A is preferably a polyethylene film layer or a polypropylene film layer. The thickness of the fragrance-permeable resin layer 30A is preferably 10 to 100 μm, and more preferably 15 to 60 μm, in consideration of a strength of the sustained fragrance release effect and the cost and productivity of the fragrant film.

A layer that is preferable as the fragrance-impermeable resin layer 32B may be a polyethylene terephthalate film layer, a polyvinylidene chloride film layer, an EVOH resin film layer (i.e., ethylene-vinylalcohol copolymer film layer) such as EVAL produced by Kuraray Co. Ltd, or a film layer formed of an EVOH resin containing styrene elastomer. Especially, a polyethylene terephthalate film layer is preferable because of the low cost. The thickness of the fragrance-impermeable resin layer 32B is preferably 10 to 50 μm in consideration of the securement of a sufficient fragrance impermeability and the cost and productivity of the fragrant film.

Examples of the fragrance layer 30C include a thin-film adhesive layer or thin-film pressure-sensitive adhesive layer containing fragrance and a resin film layer containing fragrance. In the case of the fragrance layer 30C being formed as an adhesive layer or the like, a usable material may be a natural-rubber, natural-rubber-latex, acrylic, hot-melt, or polyester adhesive or pressure-sensitive adhesive. Preferably, a polyester adhesive or an acrylic pressure-sensitive adhesive is used. In the case of a resin film containing fragrance, the base resin is preferably rubber block copolymer containing styrene block and diene block. Examples of such rubber block copolymer include styrene-butadiene copolymer, styrene-isoprene copolymer, styrene-butadiene-styrene copolymer, styrene-isoprene-styrene copolymer, styrene-isoprene-butylene-styrene copolymer, styrene-ethylene-propylene-styrene copolymer, and a hydrogen additive of these.

As fragrance to be contained in the fragrance layer, natural or synthetic known fragrance is usable. The scented tissue product 100 according to the present invention can be particularly effective with the inclusion of heavier-than-air fragrance and lighter-than-air fragrance due to the positon at which the fragrant film 32 is attached. It is thus preferable that both of these components are included. Specific examples of the fragrance include natural fragrance such as lemon oil, grapefruit oil, rosemary oil, peppermint oil, mandarin oil, lime oil, yuzu oil, chamomile oil, lavender oil, rose oil, and spearmint oil and synthetic terpene fragrance such as alcohol, ketone, aldehyde, limonene, linalool, citronellol, menthol, and geraniol.

Further, the fragrance layer 32C may contain, in addition to fragrance, deodorant for suppressing the pulp odor of the tissues 2*t* and chemical solution such as milder-proofing agent.

The thickness of the fragrance layer 32C is preferably 5 to 80 μm, and is most preferably 15 to 35 μm. The amount of contained fragrance is preferably 0.5 to 15 $g/m^2$, and is most preferably 1 to 6 $g/m^2$.

The fragrance-permeable resin layer 32A, the fragrance-impermeable resin layer 32B, and the fragrance layer 32C of the fragrant film 32 according to the present embodiment can be formed as laminated, integrated layers by use of the T-die co-extrusion method, the extrusion lamination method, or the dry lamination method. Each of the fragrance-permeable resin layer 32A, the fragrance-impermeable resin layer 32B, and the fragrance layer 32C is not necessarily a single layer, and may be multilayers as long as its intended function is not undermined. The fragrant film 32 according to the present embodiment may include one or more layers such as a layer for layer-bonding purposes.

Figure 12:
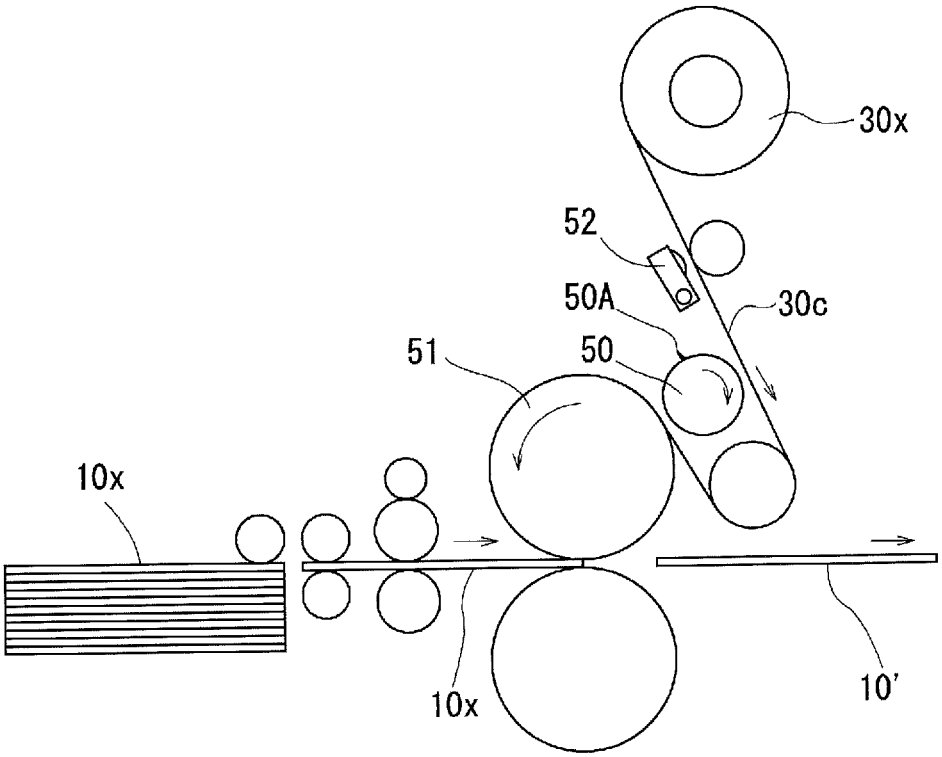
FIG. 12 is a drawing illustrating the manner in which a film having a slit therein is attached to a carton blank.

In order to manufacture the tissue product 100 for which the area of the annular opening-purpose perforation 20 is covered with the film 30 having a slit therein, a film sheet 30*c* is successively pulled out from an original roll 30*x*, as illustrated in FIG. 12, which is a roll of a film sheet that is subsequently turned into a film 30 having a slit therein. A slit cutter 52 makes a slit. A rotational cutter 50 having a cutter blade 50A extending in the width direction on the circumferential surface of the roll cuts the film sheet 30*c* into a sheet having an appropriate length. The sheet is transferred to, and further conveyed by, a roll 51 having a vacuum function and situated to face the rotational cutter 50. The sheet is bonded to a predetermined area of a carton blank 10*x* which is successively supplied without a film attached thereon and has glue in such a predetermined area, thereby producing a carton blank 10' on which the film 30 having a slit therein is attached. Thereafter, the carton blank 10' is built into a box, into which the tissue stack 2 is inserted, followed by sealing the flaps F.

Figure 13:
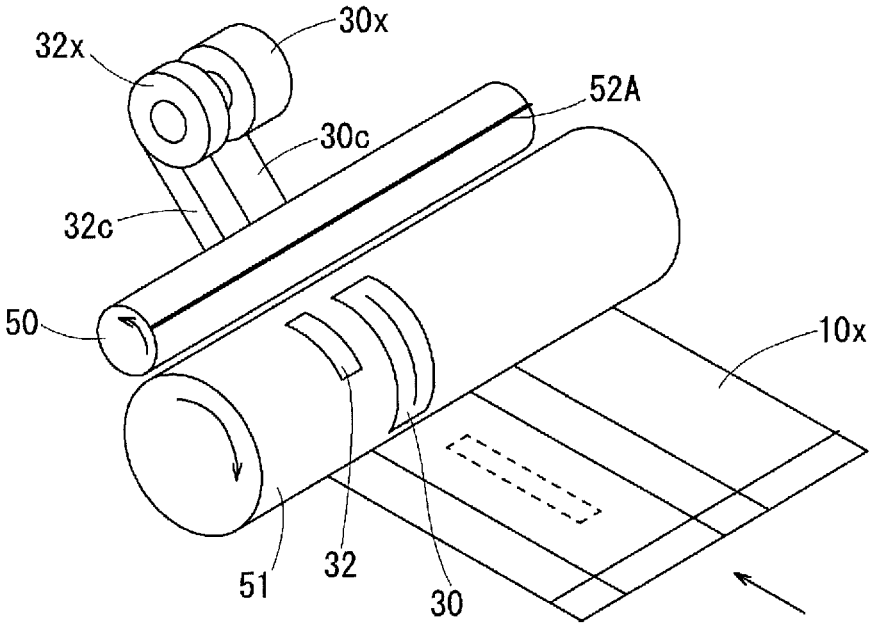
FIG. 13 is a drawing illustrating how a film having a slit therein and a scented film are attached according to the embodiment of the present invention.

In order to avoid reduction in productivity and to ensure that the fragrant film 32 be easily and reliably attached to the intended area, the method of manufacturing the scented tissue product 100 according to the present invention is performed as follows. An apparatus for attaching the film 30 having a slit therein to the carton blank 10*x* is used to pull out the continuous fragrant film 32*c* from the original roll 32*x* that is a roll of the belt-shaped, continuous fragrant film 32*c*, as illustrated in FIG. 13 (in which the slit cutter is not shown). The rotational cutter 50 which cuts a film sheet 30*c* into a film having a slit therein receives the continuous fragrant film 32*c* at a different position in the width direction than the film sheet 30*c* for a film having a slit therein, and cuts the continuous fragrant film 32*c* simultaneously with the film having a slit therein. Thereafter, the fragrant film 32 is transferred to, and conveyed by, the roll 51 having the vacuum function, and is attached to the carton blank 10*x* simultaneously with the film 30 having a slit therein. This arrangement does not need the time and labor dedicated specifically for attaching the fragrant film 32, thereby avoiding reduction in the productivity of the tissue product 100. For the scented tissue product 100 manufactured by the noted production method, the film sheet 30*c* for the film 30 having a slit therein and the continuous fragrant film 32*c* for the fragrant film 32 are cut simultaneously by the rotational cutter 50. Because of this, the film 30 having a slit therein and the fragrant film 32 are attached to the carton blank 10*x* such that ends of these films on at least one side in the longitudinal direction of the container box are aligned with each other as illustrated in the example shown in. FIG. 2 and FIG. 3 as well as the examples shown in FIG. 6 and FIG. 7 (the aligned positions shown by symbol P in FIGS. 3, 6, and 7).

In other words, the configuration, in which the film 30 having a slit therein and the fragrant film 32 are attached such that ends of these films on at least one side in the longitudinal direction of the container box are aligned with each other, can be manufactured by the described method, thereby having a merit in terms of production.

Figure 6:
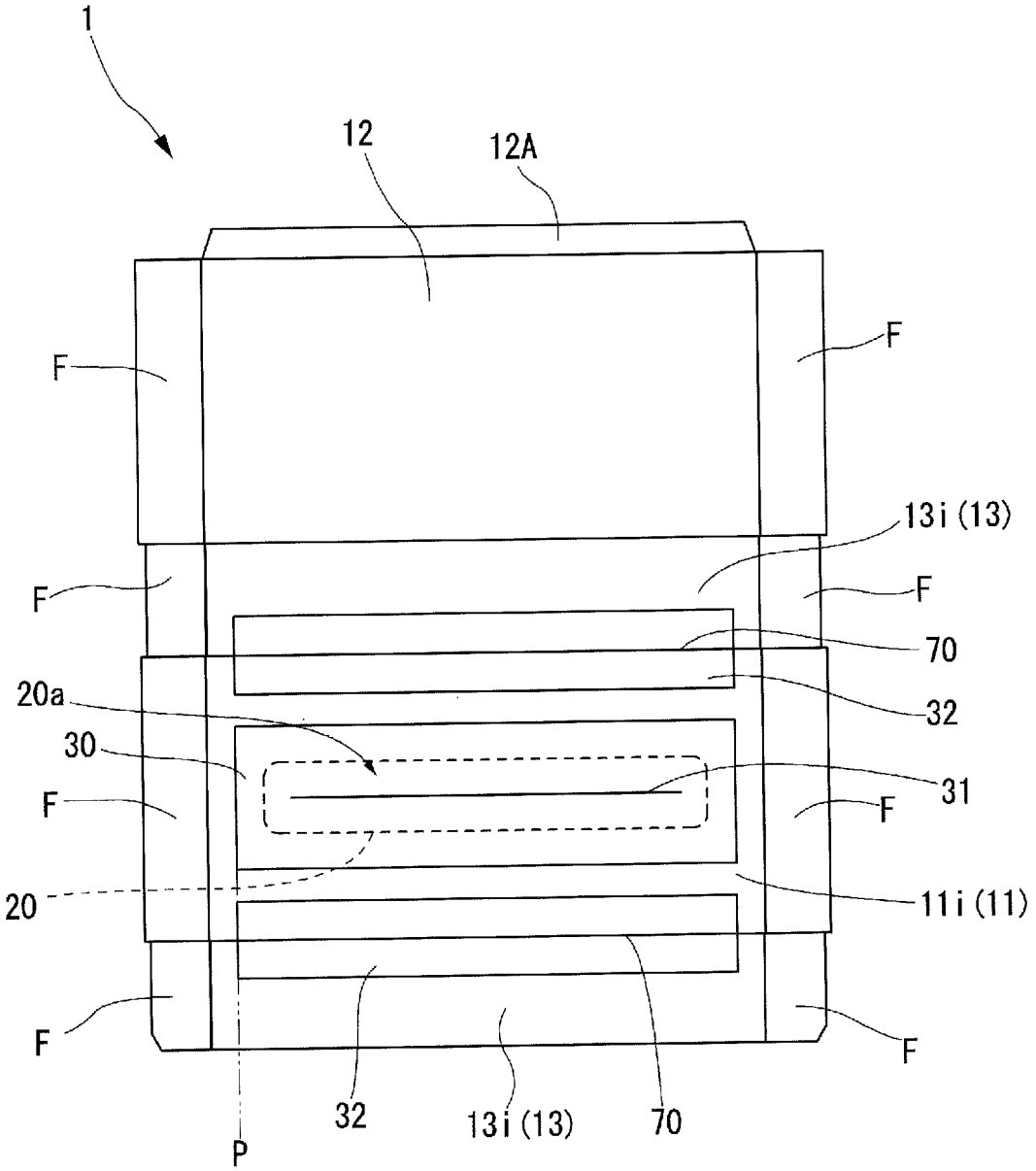
FIG. 6 is a development view of a container box illustrating an example of the manner in which a film is attached in a scented tissue product according to the embodiment of the present invention.
Figure 7:
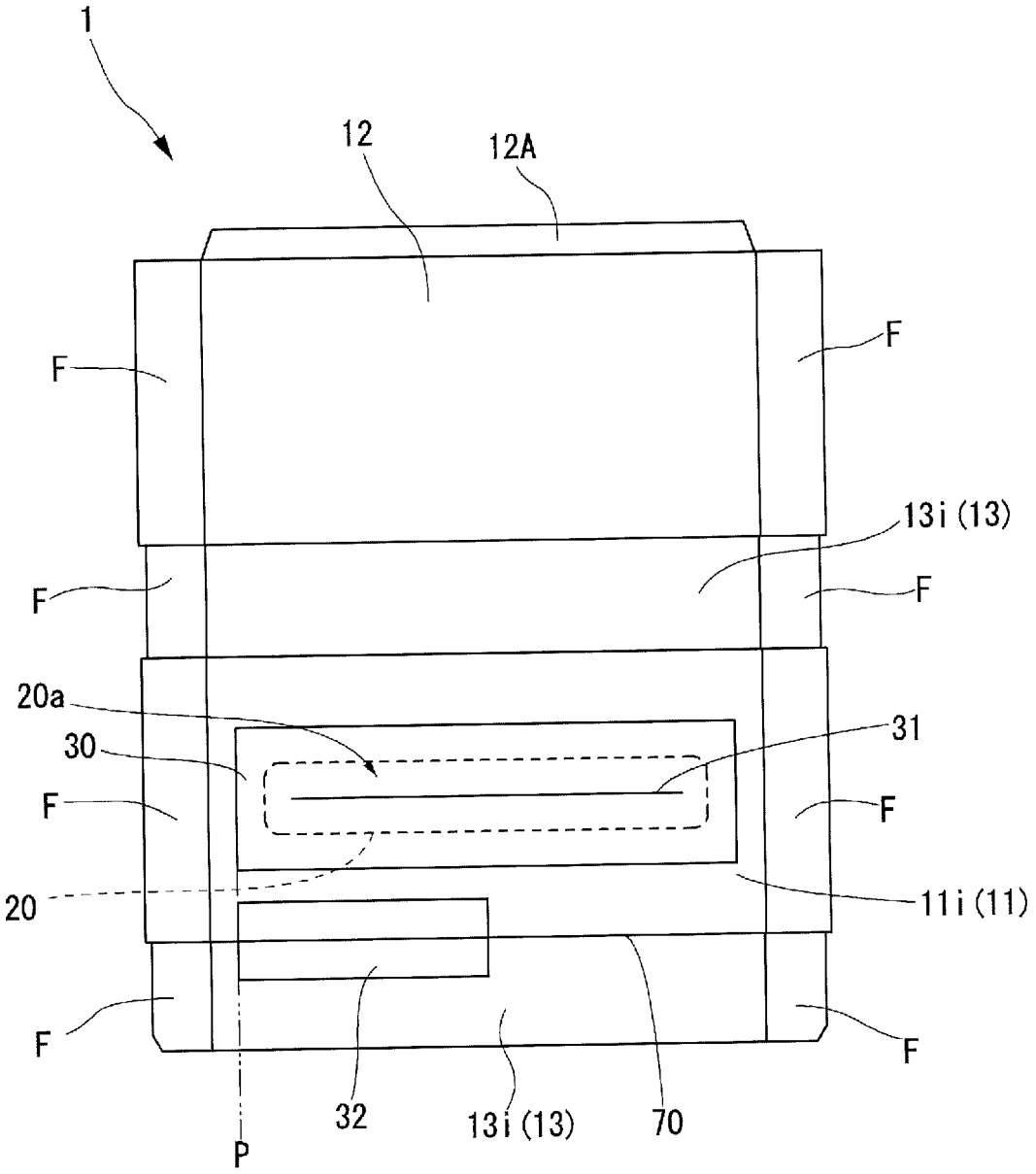
FIG. 7 is a development view of a container box illustrating another example of the manner in which a film is attached in a scented tissue product according to the embodiment of the present invention.
Figure 8:
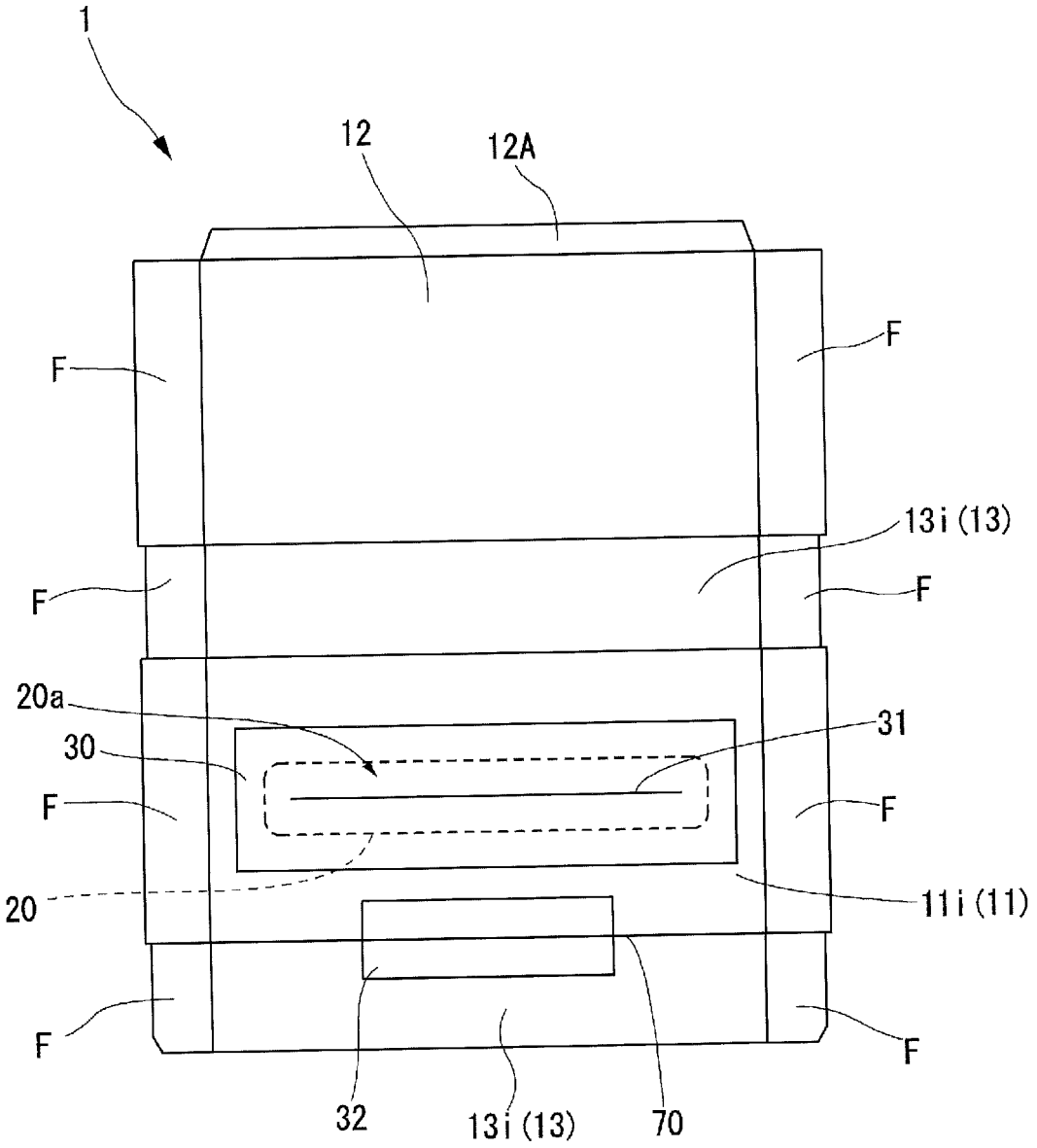
FIG. 8 is a development view of a container box illustrating a different example of the manner in which a film is attached in a scented tissue product according to the embodiment of the present invention.
Figure 9:
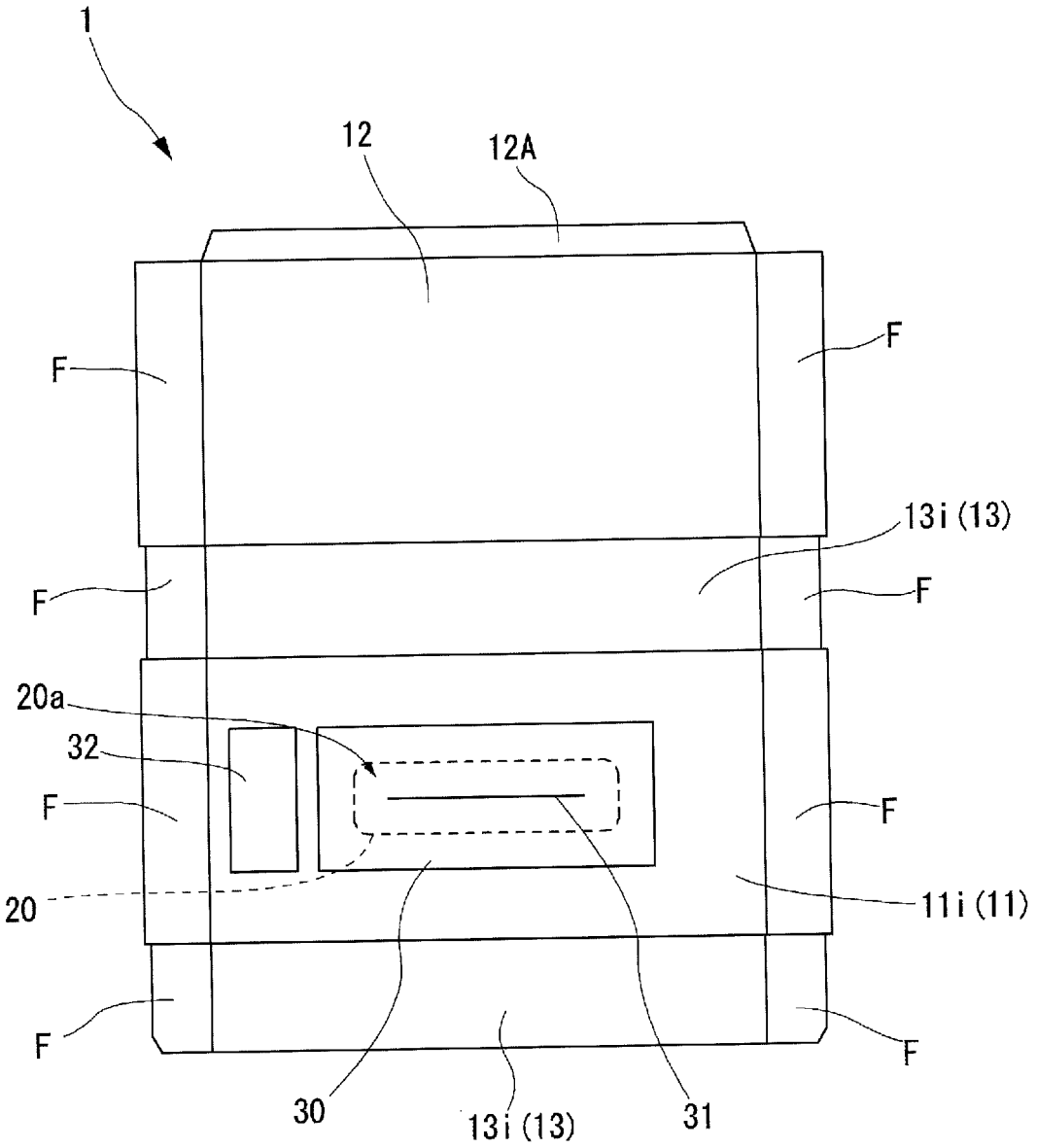
FIG. 9 is a development view of a container box illustrating a further different example of the manner in which a film is attached in a scented tissue product according to the embodiment of the present invention.

It may also be noted that the fragrant film 32 of the scented tissue product 100 according to the present invention is not limited to one sheet, but two or more sheets may be attached as illustrated in FIG. 6. In this case, the type of fragrance and configuration of these fragrant films do not have to be the same.

A description will now be given of the tissue stack 2 contained in the container box 1 having the configuration described heretofore. The tissue stack 2 includes rectangular tissues 2*t* which are substantially folded in half, and are interfolded and stacked one over another such that the edges of a given tissue 2*t* are situated between the folded halves of the adjacent tissues 2*t* that are next higher and next lower, respectively. Here, the term "substantially" indicates the tolerance to a slight folding created at the edges inevitably by the manufacturing process.

Pulling up one folded sheet situated at the top of the tissue stack 2 having the multilayer structure causes an adjacent folded sheet situated immediately below to be dragged and pulled upwards due to friction. The tissue stack 2 having such a structure is contained in the container box 1 such that the top face thereof faces the top face 11 of the container box 1 having the dispensing opening 20X. When a first pair (i.e., the pair situated at the top face) is pulled out through the dispensing opening 20X and through the slit 31 in particular, part of another pair situated immediately below is exposed. The number of stacked tissues 2*t* in the present invention is not limited to a particular number. The number of stacked tissues generally contained in this type of product is 120 to 240 pairs.

The tissue stack 2 may be produced by a known multi-stand-type or rotary-type interfolder.

The tissues 2*t* constituting the tissue stack 2 preferably have a multiple-ply structure in which two or three tissue paper layers are placed one over another.

The raw-material pulp for tissue paper is a combination of NBKP and LBKP, and may contain recycled pulp as appropriate. From the viewpoint of texture, however, the use of only NBKP and LBKP is preferable. As a ratio of mixture, NBKP:LBKP is preferably 20:80 to 80:20. More preferably, NBKP:LBKP is 30:70 to 60:40.

The basis weight of a tissue paper layer serving as each ply of the tissues 2*t* according to the present invention is preferably 9 to 25 g/m$^2$, and is more preferably 10 to 15 g/m$^2$. A basis weight lower than 9 g/m$^2$ is preferable from the viewpoint of softness improvement, but presents difficulty in securing a sufficient strength required for use. Conversely, a basis weight exceeding 25 g/m$^2$ results in every part of the sheet being hard, and, also, ends up creating hard, clumsy texture and giving an unpleasant tactile feel. It may be noted that the basis weight is measured by the method of measuring a basis weight as defined in JIS P 8124 (1998).

The thickness of a 2-ply tissue according to the present invention is 100 to 160 μm, and is more preferably 120 to 140 μm. A paper thickness less than 100 μm is preferable from the viewpoint of softness improvement, but presents difficulty in securing a sufficient strength as a facial tissue. A paper thickness exceeding 160 μm ends up degrading the tactile feeling of the tissue and creating hard, clumsy texture that is felt when used.

The thicknesses of paper, a film having a slit therein, and a fragrant film are measured by using the dial thickness gauge (i.e., thickness measurement device) "PEACOCK G" manufactured by OZAKI MFG. CO., LTD. under the condition defined by JIS P8111 (1998) after subjecting a test piece to sufficient humidity conditioning under the same condition as noted. The thickness of paper is measured under the same condition as in the product, i.e., measuring 2-ply tissue for a 2-ply product and 3-ply tissue for a 3-ply product. Specifically, a check is first made to make sure that neither dust nor speck is present between the plunger and the platform, and, then, the plunger is lowered to come in contact with the platform, followed by moving the scale of the dial thickness gauge to align the zero point. Thereafter, the plunger is moved up, and, a specimen is placed on the platform, followed by slowly lowering the plunger, and then reading the gauge. In so doing, the plunger is only placed on the specimen. The end of the plunger is a circular flat metal plane with a diameter of 10 mm, which is brought in contact with the tissue plane face-to-face. The load at the time of thickness measurement is approximately 70 gf in the case of 120 μm. The thicknesses of paper, a sheet material, and a film used as a film layer are obtained by taking an average of 10 measurements.

DESCRIPTION OF REFERENCE SYMBOLS

100 . . . tissue product
2 . . . tissue stack
2*t* . . . tissues
11 . . . top face of container box (paper box)
20 . . . opening-purpose perforation
1 . . . container box
20*a* . . . area enclosed by opening-purpose perforation
20X . . . dispensing opening
30 . . . film having a slit therein
10 . . . box member
12 . . . bottom face of container box (paper box)
12A . . . tab
13 . . . longitudinal lateral face of container box (paper box)
14 . . . transverse lateral face of container box (paper box)
F . . . flap
31 . . . slit
32 . . . fragrant film
32A . . . fragrance-permeable layer
32B . . . fragrance-impermeable layer
32C . . . fragrance layer
L1 . . . long-side edge of container box
L2 . . . short-side edge of container box
L3 . . . height of container box
11*i* . . . inner surface of top face of container box (paper box)
13*i* . . . inner surface of longitudinal lateral face of container box (paper box)
70 . . . border edge
60A, 60B . . . adhesive
30*x* . . . original roll
30*c* . . . film sheet
50A . . . cutter blade
50 . . . rotational cutter
51 . . . roll having vacuum function
10*x*, 10' . . . carton blank
32*x* . . . original roll
32*c* . . . continuous fragrant film
P . . . position of alignment for fragrant film and film having slit therein

The invention claimed is:

1. A method of making a scented carton blank for a tissue product, comprising:

supplying a continuous film sheet and a continuous fragrant film sheet, arranged alongside each other, to a cutter, the continuous fragrant film sheet having a fragrance layer situated between a fragrance-permeable resin layer and a fragrance-impermeable resin layer;

simultaneously cutting, with the cutter, a predetermined length of the continuous film sheet and a predetermined length of the continuous fragrant film sheet, to produce a severed film piece having a slit therein and a severed fragrant film piece;

causing the severed film piece having a slit therein and the severed fragrant film piece to adhere by suction to a surface of a roller while being carried on the surface of the roller along with rotation of the roller; and transferring the severed film piece having a slit therein and the severed fragrant film piece simultaneously from the surface of the roller to a carton blank to cause the severed film piece having a slit therein and the severed fragrant film piece each separated from the roller to be fixedly attached on the carton blank, such that the slit is situated in an area enclosed by an opening-purpose perforation.

* * * * *